US010280950B2

(12) United States Patent
Yonezawa et al.

(10) Patent No.: US 10,280,950 B2
(45) Date of Patent: May 7, 2019

(54) ROD-LESS CYLINDER EQUIPPED WITH GUIDE MECHANISM

(71) Applicant: Howa Machinery, Ltd., Aichi (JP)

(72) Inventors: Tsuyoshi Yonezawa, Aichi (JP); Yoshimi Moriyama, Aichi (JP)

(73) Assignee: HOWA MACHINERY, LTD., Aichi (JP)

( * ) Notice: Subject to any disclaimer, the term of this patent is extended or adjusted under 35 U.S.C. 154(b) by 77 days.

(21) Appl. No.: 15/520,761

(22) PCT Filed: Oct. 19, 2015

(86) PCT No.: PCT/JP2015/079436
§ 371 (c)(1),
(2) Date: Apr. 20, 2017

(87) PCT Pub. No.: WO2016/063831
PCT Pub. Date: Apr. 28, 2016

(65) Prior Publication Data

US 2017/0306991 A1 Oct. 26, 2017

(30) Foreign Application Priority Data

Oct. 21, 2014 (JP) ..... 2014-214786

(51) Int. Cl.
*F01B 29/00* (2006.01)
*F15B 15/08* (2006.01)

(52) U.S. Cl.
CPC ..... *F15B 15/084* (2013.01); *F15B 15/082* (2013.01)

(58) Field of Classification Search
CPC ..... F15B 15/082; F15B 15/084
(Continued)

(56) References Cited

U.S. PATENT DOCUMENTS 5,555,789 A * 9/1996 Rosengren ..... F15B 15/082 384/57
6,092,456 A * 7/2000 Noda ..... F02B 71/04 277/567

(Continued)

FOREIGN PATENT DOCUMENTS

JP 2-138507 5/1990
JP H3-2902 U 1/1991

(Continued)

OTHER PUBLICATIONS

International Search Report issued by the Japanese Patent Office in corresponding International Application No. PCT/JP2015/079436, dated Jan. 19, 2016 (2 pages).

*Primary Examiner* — Michael Leslie
(74) *Attorney, Agent, or Firm* — Finnegan, Henderson, Farabow, Garrett & Dunner, LLP

(57) ABSTRACT

In this rod-less cylinder equipped with a guide mechanism (32), the guide mechanism (32) has: a first rail member (34), which is attached to the sidewall of a cylinder tube (2), has an inner rolling groove (34*a*), and is composed of alloyed steel; a second rail member (36), which is attached to a protrusion (31) of a slider (27), has an outer rolling groove (36*a*), and is composed of alloyed steel; a guide path (38*a*) provided in the protrusion of the slider and extending parallel to the second rail member; a connection member (39) having a connection path (39*a*) that connects the guide path and the inner rolling groove; and a plurality of rolling bodies (43) accommodated within an endless circulation path (42) formed of the inner rolling groove, the outer rolling groove, the guide path, and the connection path.

1 Claim, 4 Drawing Sheets

(58) Field of Classification Search
USPC ..... 92/88
See application file for complete search history.

(56) References Cited

U.S. PATENT DOCUMENTS

| | | | | |
|---|---|---|---|---|
| 6,101,921 | A * | 8/2000 | Granberg | F15B 15/082 92/128 |
| 8,955,424 | B2 * | 2/2015 | Ishibashi | F15B 15/1404 92/146 |
| 2006/0140517 | A1 | 6/2006 | Moseberg et al. | |

FOREIGN PATENT DOCUMENTS

| | | |
|---|---|---|
| JP | 8-100807 | 4/1996 |
| JP | 11-230114 | 8/1999 |
| JP | 2002-276617 | 9/2002 |

* cited by examiner

ROD-LESS CYLINDER EQUIPPED WITH GUIDE MECHANISM

TECHNICAL FIELD

The present invention relates to a rod-less cylinder equipped with a guide mechanism designed to allow a slider guided by a guide mechanism to move back and forth by a moving member.

BACKGROUND ART

Known in the past has been a rod-less cylinder equipped with a guide mechanism and comprised of a cylinder tube having a slit in an axial direction, a piston fit in the cylinder tube, a piston mount at the outside of the cylinder tube, and a piston yoke passing through the slit and connecting the piston and piston mount thereby forming a moving member, wherein the slit is closed by inside and outside seal bands, and a slider guided by a guide mechanism is made to move back and forth by the moving member. The guide mechanism, as shown in PLT 1, is comprised of sliding guide-use grooves provided at the two sides of an outer circumferential part of a round cylinder tube and balls held in ballways provided at guide arms engaged with the same. In PLT 2, there has been known a mechanism comprised of guide rails attached to top surfaces of flange parts formed at a bottom part of a cylinder and guide members attached to the inside of a bottom end of a table and engaged with the same.

CITATION LIST

Patent Literature

PLT 1: Japanese Utility Model Publication No. 3-2902Y
PLT 2: Japanese Patent Publication No. 2721301

SUMMARY OF INVENTION

Technical Problem

In PLT 1, when a large load is applied to the guide arms from the vertical and horizontal directions, since sliding guide-use grooves made of an aluminum material have a low limit surface pressure, the pressing force on the plurality of balls say cause dents in the grooves and other effects on the rolling motion of the balls. There is the problem that the guide arms moving along the grooves could no longer smoothly move. Further, since the grooves are formed at the outer circumference part of a round cylinder tube, the centers of the grooves became the center position of the cylinder tube in the vertical direction. However, if pressurized air is fed to the inside of the cylinder tube, the outer circumference part of the cylinder tube elastically deformed to the outside and the grooves applied load to the balls. It is not possible to reduce the load by arranging the centers of the grooves below the center position of the cylinder tube in the vertical direction. In PLT 2, it is necessary to fasten the guide rails on the top surfaces of the flange parts sticking out from the side surfaces of the cylinder in the width direction. The span of the cylinder in the width direction is larger and the position for attachment of the cylinder may be limited. Therefore, an object of the present invention, in consideration of the above problems, is to provide a rod-less cylinder equipped with a guide mechanism designed to enable a moving member to smoothly move back and forth even when a large load acts on a slider guided by a guide mechanism from the vertical or horizontal direction.

Solution to Problem

The present invention provides a rod-less cylinder equipped with a guide mechanism, the cylinder comprising a moving member comprised of a piston fit in a cylinder hole of a cylinder tube having a slit in an axial direction, a piston mount at an outside of the cylinder tube, and a piston yoke passing through the slit to connect the piston and piston mount, wherein the slit is closed by inside and outside seal bands, and a slider guided by the guide mechanism being made to move back and forth by the moving member, characterized in that the slider is formed so as to straddle a top surface of the cylinder tube, and the guide mechanism is provided between projecting parts sticking out downward and formed at the two ends of the slider in the width direction and side walls of the cylinder tube and has first rail members attached in a longitudinal direction of the cylinder tube, forming inside rolling grooves, and comprised of alloy steel, second rail members attached to the projecting parts of the slider, forming outside rolling grooves, and comprised of alloy steel, guide paths provided at projecting parts of the slider parallel with the second rail members, connecting members forming connecting paths connecting the guide paths and inside rolling grooves, and pluralities of rolling members held inside endless circulation paths formed by the inside rolling grooves, outside rolling grooves, guide paths, and connecting paths. Furthermore, the cylinder hole formed in the cylinder tube is non-circular, and centers of the circulation paths formed by the inside rolling grooves and outside rolling grooves are arranged below the center position of the cylinder hole in a vertical direction.

Advantageous Effects of Invention

In the present invention, when a large load acts on the slider moving due to the moving member from the vertical or horizontal direction, the load causes the pluralities of rolling members to press against the inside rolling grooves of the first rail members and the outside rolling grooves of the second rail members, but the limit surface pressures of inside and outside rolling grooves made of alloy steel are high and therefore there are no dents made in the grooves or other effects on the rolling motion or the rolling members. Accordingly, even when the load is applied, the slider can be made to smoothly move back and forth. Further, by attachment of the first rail members of the guide mechanism to the side walls of the cylinder tube, the span of the cylinder tube in the width direction does not become larger. Furthermore, since the cylinder tube is formed with a slit, while it used to be that the pressurized fluid supplied to the cylinder chamber caused the two side walls of the cylinder tube to elastically deform to the outside and apply an excessive load to the rolling members of the guide mechanism and thereby made it impossible for the slider to smoothly move and had other effects, by arranging the centers of the circulation paths formed by the inside rolling grooves and outside rolling grooves below the center position of the noncircular cylinder hole in the vertical direction, it is possible to prevent deformation of the two side walls of the cylinder tube from causing an excessive load to act on the rolling members of the guide mechanism.

DESCRIPTION OF EMBODIMENTS

Figure 1:
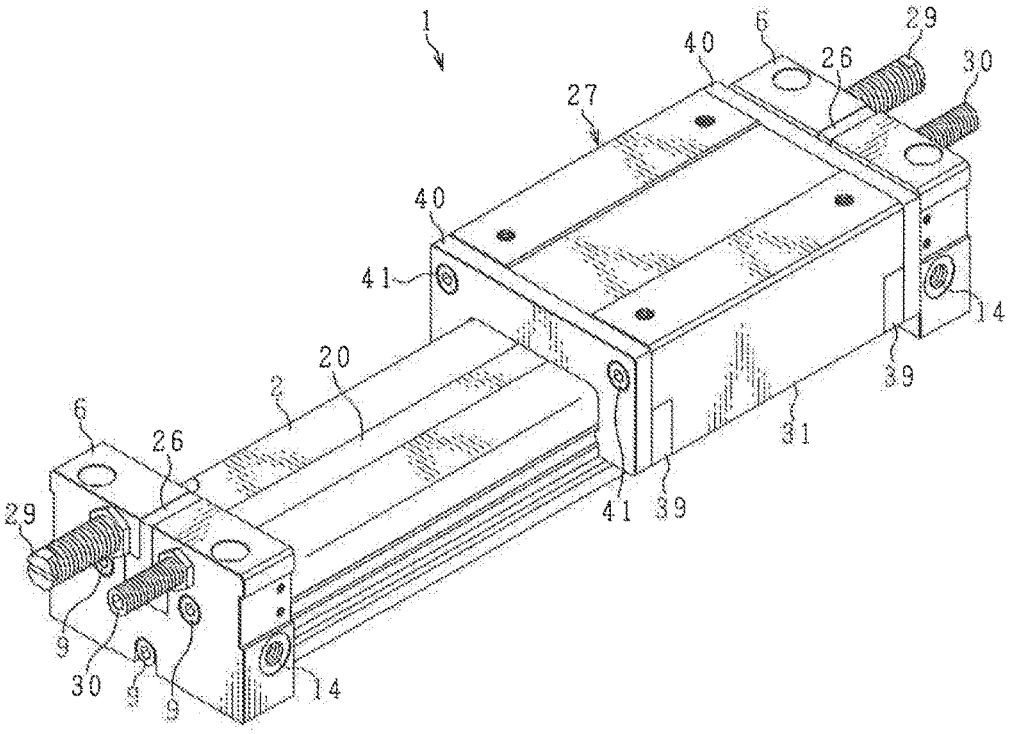
FIG. 1 is a view showing a rod-less cylinder equipped with a guide mechanism of the present embodiment.
Figure 2:
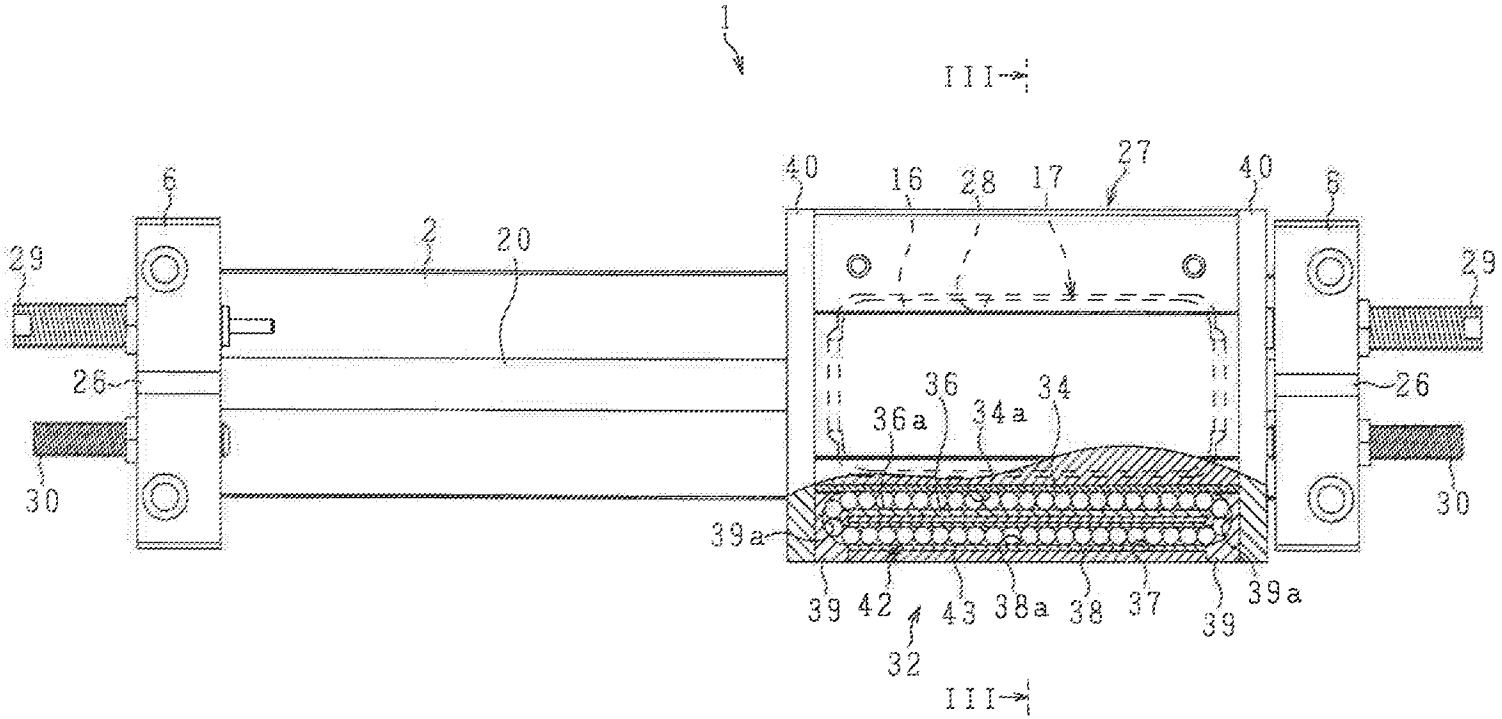
FIG. 2 is a plan view of FIG. 1.
Figure 3:
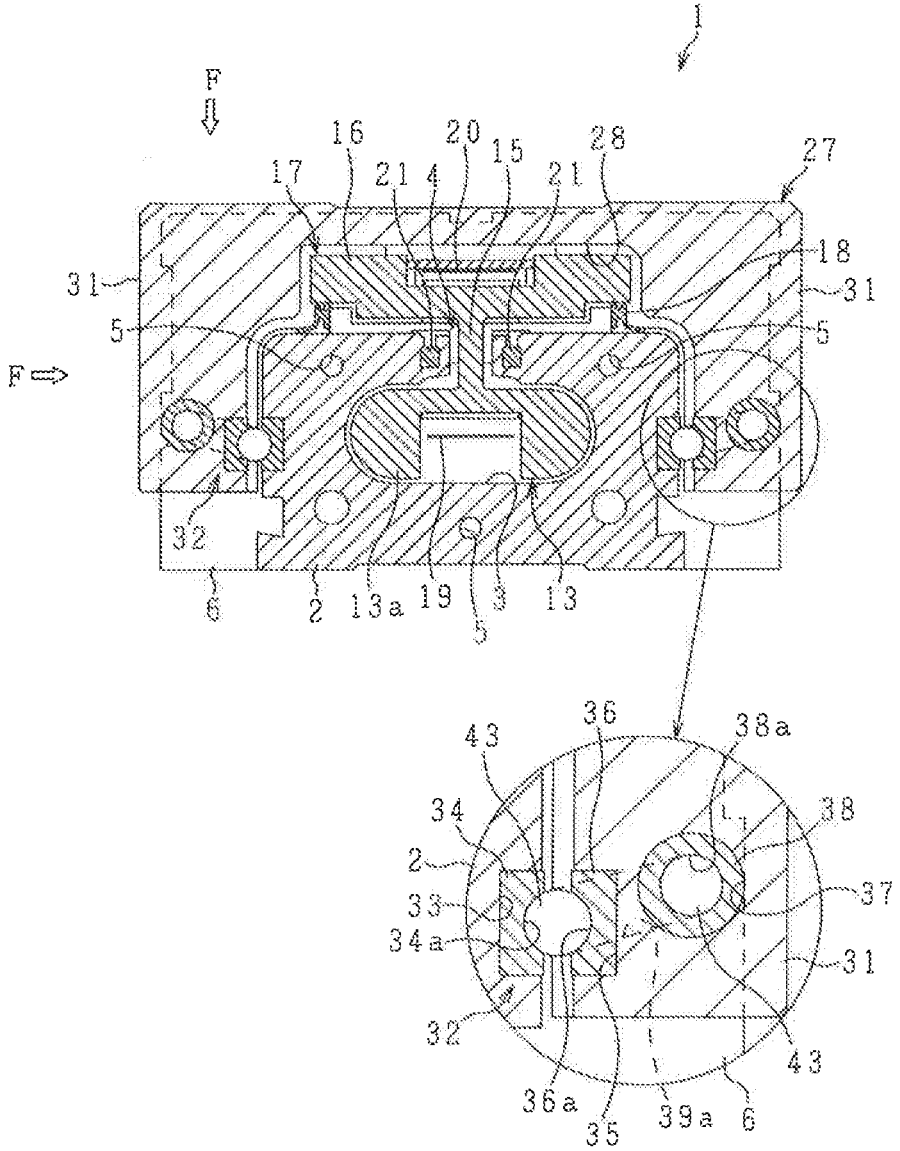
FIG. 3 is an enlarged cross-sectional view along the line III-III of FIG. 2.
Figure 4:
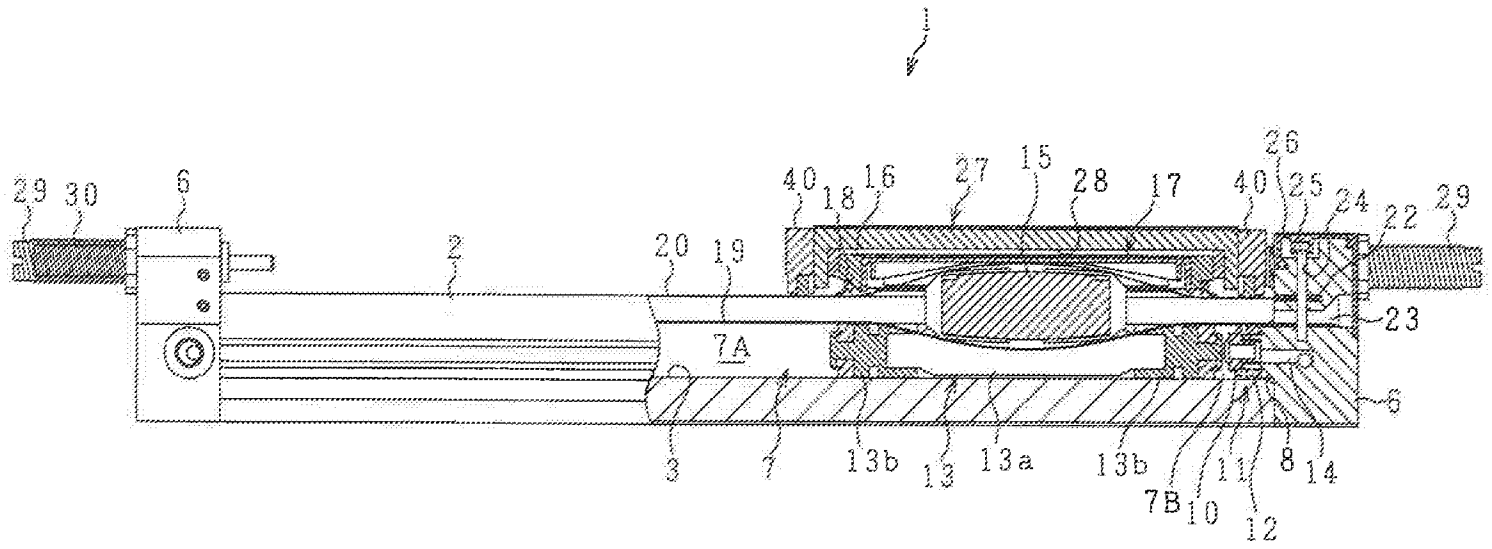
FIG. 4 is a front view of the rod-less cylinder equipped with a guide mechanism shown in FIG. 1 and a partially cutaway view.

A cylinder tube 2 of a rod-less cylinder 1 equipped with a guide mechanism shown in FIG. 1 is produced by extruding or drawing a nonmagnetic material such as aluminum. The cylinder tube 2 has a substantially rectangular cross-section. The cylinder tube 2 has a noncircular cylinder hole 3 inside it and is formed with a slit 4 extending over its entire span in the longitudinal direction. At the cylinder tube 2, as shown in FIG. 3, in addition to the cylinder hole 3 and slit 4, mounting holes 5 for mounting end members are formed parallel to the cylinder hole 3. The two end parts of the cylinder tube 2 in the longitudinal direction are closed by left and right end caps 6 shown as end members. Between the left and right end caps 6, a cylinder chamber 7 is formed. The end caps 6 are attached by inserting large diameter parts of insert shaft parts 8 formed corresponding to the cylinder hole 3 into the cylinder hole 3 and in that state screwing in tapping screws 9 into the mounting holes 5 for end member mounting-use of the cylinder tube 2. The insert shaft parts 8 have piston dampers 10 integrally attached to them. The piston dampers 10 and the insert shaft parts 8 form gasket grooves 11 into which cylinder gaskets 12 are fit.

At the cylinder hole 3 of the cylinder tube 2, a piston 13 comprised of a piston body 13*a* at the two ends of which piston ends 13*b* are provided is fit. Due to the piston 13, the cylinder chamber 7 is divided into front and rear cylinder chambers 7A, 7B. Inside the front and rear cylinder chambers 7A, 7B, pressurized fluid supplied from the supply/discharge holes 14 of the end caps 6 causes the piston 13 to move back and forth. At the piston body 13*a*, a piston yoke 15 passing through the slit 4 is integrally formed. Part of the piston yoke 15 spreads to the left and right at the outside of the cylinder tube 2 to form a piston mount 16. The piston 13, piston yoke 15 and piston mount 16 form a moving member 17. At the outer circumference of the bottom end of the piston mount 16, a scraper 18 is attached over the entire circumference. This prevents entry of dust from the clearance between the top surface of the cylinder tube 2 and the bottom surface of the piston mount 16.

The inside and outside of the slit 4 are closed by the inside and outside seal bands 19, 20. The inside and outside seal bands 19, 20 pass over the top and bottom of the piston yoke 15 and are connected at their two ends at the left and right end caps 6. The inside and outside seal bands 19, 20 are elastic bands having thin thicknesses and elasticity. For example, they are comprised of steel bands or other magnetic materials. The outside seal band 20 is pulled in by magnets 21 arranged along the lengths of the two sides of the slit 4 at the top surface of the cylinder tube 2 and close the silt 4 from the outside. Except for the part through which the piston yoke 15 passes, the inside seal band 19 closes the slit 4 from the inside by magnetic attraction force and the fluid pressure applied to the cylinder chamber 7.

The left and right end caps 6 are formed with band insertion holes 22, 23 in which the inside and outside seal bands 19, 20 are respectively fit. They are also provided with pin holes 24 extending in the vertical direction and passing through the band insertion holes 22, 23. In the band, insertion holes 22, 23, the two ends of the inside and outside seal bands 19, 20 in the longitudinal direction are fit. Not shown mounting holes provided at the two ends of the inside and outside seal bands 19, 20 and the pin holes 24 are aligned, then mounting pins 25 are inserted into the mounting holes and pin holes 24 to thereby connect the inside and outside seal bands 19, 20 to the left and right end caps 6. The left and right end caps 6 have cap covers 26 attached to them. These prevent the mounting pins 25 from being pulled out from above.

At the cylinder tube 2, a slider 27 formed so as to straddle the cylinder tube 2 is arranged. At the bottom surface side of the slider 27, a recessed part 28 is formed. By engaging the piston mount 16 of the moving member 17 with that recessed part 28 and making the moving member 17 move back and forth, the slider 27 is made to move in the longitudinal direction of the cylinder tube 2. At the left and right end caps 6, shock absorbers 29 for easing the impacts at the stroke ends of the slider 27 and adjustment bolts 30 for adjusting the stop positions of the slider 27 are attached. At the two ends of the slider 27 in the width direction, projecting parts 31 are formed so as to stick out downward. Between those projecting parts 31 and the side walls of the cylinder tube 2, a guide mechanism 32 for guiding the slider 27 along the longitudinal direction of the cylinder tube 2 is provided.

The guide mechanism 32 will be explained next. At the two side walls of the cylinder tube 2, first recessed grooves 33 are formed. First rail members 34 forming inside rolling grooves 34*a* having cross-sectional shapes of gothic arch shapes comprised of two arcs and made of alloy steel are fit in the first recessed grooves 33. At the projecting parts 31 of the slider 27, second recessed grooves 35 are formed at positions facing the first recessed grooves 33. Second rail members 36 forming outside rolling grooves 36*a* of the same shapes as the inside rolling grooves 34*a* and made of alloy steel are fit in the second recessed grooves 35. The first and second rail members 34, 36 of the present embodiment are formed from, for example, stainless steel as the alloy steel. The projecting parts 31 of the slider 27 are formed with through holes 37 parallel to the second recessed grooves 35. In these through holes 37, tubular members 38 each having a guide path 38*a* running therethrough are held. At the projecting parts 31 of the slider 27, pairs of connecting members 39 having U-shaped connecting paths 39*a* connecting the guide paths 38*a* and the inside rolling grooves 34*a* are arranged. At the front and rear ends of the slider 27, end plates 40 are attached by bolts 41 for abutting against the connecting members 39. The inside rolling grooves 34*a*, outside rolling grooves 36*a*, guide paths 36*a*, and connecting paths 39*a* form endless circulation paths 42. In these, pluralities of spherical rolling members 43 are held. The rolling members 43 can roll along the endless circulation paths 42 due to the back and forth motion of the slider 27.

Therefore, the guide mechanism 32 has the first rail members 34 attached to the cylinder tube 2, forming the inside rolling grooves 34*a*, and made of alloy steel, the second rail members 36 attached to the slider 27, forming the outside rolling grooves 36*a*, and made of alloy steel, the guide paths 38*a* provided at the projecting parts 31 of the slider 27 parallel with the second rail members 36, the connecting members 39 forming the connecting paths 39*a* connecting the guide paths 38*a* and the inside rolling grooves 34*a*, and the pluralities of rolling members 43 held in the endless circulation paths 42 formed by the inside rolling grooves 34*a*, outside rolling grooves 36*a*, guide paths 38*a*, and connecting paths 39*a*. In the rod-less cylinder 1 equipped with the guide mechanism, when a large load F acts on the slider 27 moved by the moving member 17 from the vertical or horizontal directions, that load F causes the pluralities of rolling members 43 to press against the inside rolling grooves 34*a* of the first rail members 34 and the outside rolling grooves 36*a* of the second rail members 36. In comparison with the limit surface pressures of grooves formed by a conventional aluminum material, the limit surface pressures of the inside and outside rolling grooves 34*a*, 36*a* formed by alloy steel are high, so there is no denting of the grooves 34*a*, 36*a* or other effects on the rolling motion of the rolling members 43. Accordingly, even if the load F is applied, it becomes possible to make the slider 27 (moving member 17) smoothly move back and forth.

By attaching the first rail members 34 of the guide mechanism 32 to the side walls of the cylinder tube 2, there is no need to provide flange parts sticking out in the width direction of the cylinder tube 2 like in the past and the cylinder tube 2 does not become greater in span in the width direction. Furthermore, since a cylinder tube 2 is formed with a slit 4, it used to be that the pressurized fluid supplied to a cylinder chamber 7 caused the two side walls of the cylinder tube 2 to elastically deform to the outside and apply an excessive load to rolling members 43 of guide mechanism 32 and thereby made it impossible for slider 27 (moving member 17) to smoothly move and had other effects. On the other handy in the present embodiment, by arranging the centers of the circulation paths 40 formed by the inside rolling grooves 34*a* and outside rolling grooves 36*a* below the center position of the noncircular cylinder hole 3 in the vertical direction, the guide mechanism 32 is provided at a position further away from the slit 4 than in the past so deformation of the two side walls of the cylinder tube 2 no longer causes an excessive load to act on the rolling members 43 of the guide mechanism 32.

REFERENCE SIGNS LIST

1. rod-less cylinder equipped with guide mechanism
2. cylinder tube
3. cylinder hole
4. slit
13. piston
15. piston yoke
16. piston mount
17. moving member
27. slider
31. projecting part
32. guide mechanism
34. first rail member
34*a*. inside rolling groove
36. second rail member
36*a*. outside rolling groove
38*a*. guide path
39*a*. connecting path
42. circulation path
43. rolling member

The invention claimed is:

1. A rod-less cylinder equipped with a guide mechanism, the cylinder comprising a moving member comprised of a piston fit in a cylinder hole of a cylinder tube having a slit in an axial direction, a piston mount at an outside of the cylinder tube, and a piston yoke passing through the slit to connect the piston and piston mount, wherein the slit is closed by inside and outside seal bands, and a slider guided by the guide mechanism being made to move back and forth by the moving member, wherein the slider is formed so as to straddle a top surface of the cylinder tube, and the guide mechanism is provided between projecting parts sticking out downward and formed at the two ends of the slider in the width direction and side walls of the cylinder tube and has first rail members attached in a longitudinal direction of the cylinder tube, forming inside rolling grooves, and comprised of alloy steel, second rail members attached to the projecting parts of the slider, forming outside rolling grooves, and comprised of alloy steel, guide paths provided at projecting parts of the slider parallel with the second rail members, connecting members forming connecting paths connecting the guide paths and inside rolling grooves, and pluralities of rolling members held inside endless circulation paths formed by the inside rolling grooves, outside rolling grooves, guide paths, and connecting paths, wherein the cylinder hole formed in the cylinder tube is non-circular, and centers of the circulation paths formed by the inside rolling grooves and outside rolling grooves are arranged below the center position of the cylinder hole in a vertical direction.

* * * * *